US005634576A

United States Patent [19]

Arbel

[11] Patent Number: 5,634,576

[45] Date of Patent: Jun. 3, 1997

[54] KNAPSACK

[75] Inventor: Itai Arbel, Tel-Aviv, Israel

[73] Assignee: Armadilo Ltd., Kfar Shmaryahu, Israel

[21] Appl. No.: 556,563

[22] Filed: Nov. 13, 1995

[51] Int. Cl.[6] ..... A45F 4/02

[52] U.S. Cl. ..... 224/153; 224/580; 224/583; 224/148.2; 224/629; 224/637; 224/644; 224/652; 224/653; 224/654; 224/657

[58] Field of Search ..... 224/153, 576, 224/577, 629, 644, 580, 583, 148.2, 637, 653, 654, 657, 652

[56] References Cited

U.S. PATENT DOCUMENTS

| | | | |
|---|---|---|---|
| 518,270 | 4/1894 | Orth | 224/629 |
| 2,823,971 | 2/1958 | Hoyt | 224/629 |
| 3,902,640 | 9/1975 | Geiben | 224/153 |
| 4,883,207 | 11/1989 | McArthur | 224/644 |
| 5,447,261 | 9/1995 | Mitomi et al. | 224/153 |
| 5,544,792 | 8/1996 | Arnwine | 224/153 |

*Primary Examiner*—Linda J. Sholl
*Attorney, Agent, or Firm*—Fitch, Even, Tabin & Flannery

[57] ABSTRACT

A knapsack to be carried on a person's back comprising a storage compartment and a carrying unit. The storage compartment comprises a bottom wall, a back wall facing the person, a front wall and side wall portions adjacent the back wall. The walls of the storage compartment being substantially rigid and it comprises one or more openings. The carrying unit is releasably attached to the back wall, and comprises carrying straps and a collapsible rucksack which is collapsed when the carrying unit is attached to the storage compartment and may be expanded into a rucksack shape when the carrying unit is detached from the storage compartment.

16 Claims, 9 Drawing Sheets

KNAPSACK

FIELD OF THE INVENTION

The present invention relates to bags and more specifically to a knapsack carried on a person's back and suitable for carrying and convenient storage of articles.

BACKGROUND OF THE INVENTION

Knapsacks of the kind specified are widely used among travellers and campers who wish to carry many articles, e.g. clothing, camping equipment, personal items, etc.

A variety of large knapsacks for carrying on a person's back are known. However, such knapsacks are typically made of a flexible material, e.g. fabric, wherein the articles are merely piled in layers rather than stored in a "cupboard-like" manner, e.g. a manner in which the stored articles are fairly arranged and accessed.

Another drawback of such knapsacks is that if a camper wishes to carry only part of his belongings (e.g. while going on a day hike), the remaining articles should be removed from the knapsack and transferred to another bag or storage arrangement, and at a later stage they should be returned to the knapsack.

A further disadvantage of the typical knapsacks made of flexible material is that they do not provide any protection to fragile items carried or stored in such a knapsack.

It is an object of the present invention to provide a novel knapsack in which the above-referred to disadvantages are significantly reduced or overcome.

SUMMARY OF THE INVENTION

According to the present invention there is provided a knapsack to be carried on a person's back comprising a storage compartment and a carrying unit; the storage compartment comprising a bottom wall, a back wall facing the person, a front wall and side wall portions adjacent the back wall; the walls of the storage compartment being substantially rigid and it comprises one or more openings; the carrying unit being releasably attached to said back wall, and comprises carrying straps and a collapsible rucksack which is collapsed when the carrying unit is attached to the storage compartment and may be expanded into a rucksack shape when the carrying unit is detached from the storage compartment.

The arrangement according to the present invention is such that said collapsible rucksack forms a padding between the person's back and said back wall of the storage compartment.

In a preferred embodiment of the present invention, the bottom wall comprises a pair of wheels. By still a preferred embodiment, the bottom wall is designed so as to stably support the knapsack in an upright position. In a preferred configuration of the invention the bottom wall has three resting points for stably supporting the knapsack when placed on the bottom wall, two of the resting points being said wheels.

In accordance with one application of the present invention the wheels are at the intersection between the back wall and the bottom wall.

The openings of the storage compartment may be provided at any one or more of the walls of the storage compartment and the one or more openings of the storage compartment may be closable by rigid doors hinged and lockable to rigid portions of the storage compartment.

Alternatively, said one or more openings may be made of a flexible material, with one or more openings being in said material. The openings may also be closed by a combination of rigid and flexible doors.

In still another embodiment of the invention the storage compartment comprises a rigid top portion comprising a closable compartment, which storage compartment may comprise an opening of said storage compartment or may be an independent compartment. The independent compartment may be a liquid container or comprise a removable liquid container, or a detachable pouch.

In still a preferred embodiment, the storage compartment comprises modular partitions for dividing the storage compartment's interior.

According to a modification of the present invention, the storage compartment is essentially waterproof and it comprises a water-tight closure within said closable compartment.

BRIEF DESCRIPTION OF THE DRAWINGS

For better understanding, the invention will now be described in a non-limiting way, with reference to the accompanying drawings, in which:

FIG. 2(*a*) illustrates the carrying unit of FIG. 2 expanded into an independent rucksack;

FIG. 7(*b*) is a perspective view of a top portion of a knapsack according to the present invention comprising an independent liquid container;

FIG. 7(*c*) is a perspective view of a top portion of a knapsack according to the present invention comprising a detachable pouch within an independent compartment.

FIG. 9(*b*) is a perspective view of only the top portion of the embodiment illustrated in FIG. 9(*a*), with the top cover open.

DETAILED DESCRIPTION OF PREFERRED EMBODIMENTS

Figure 1:
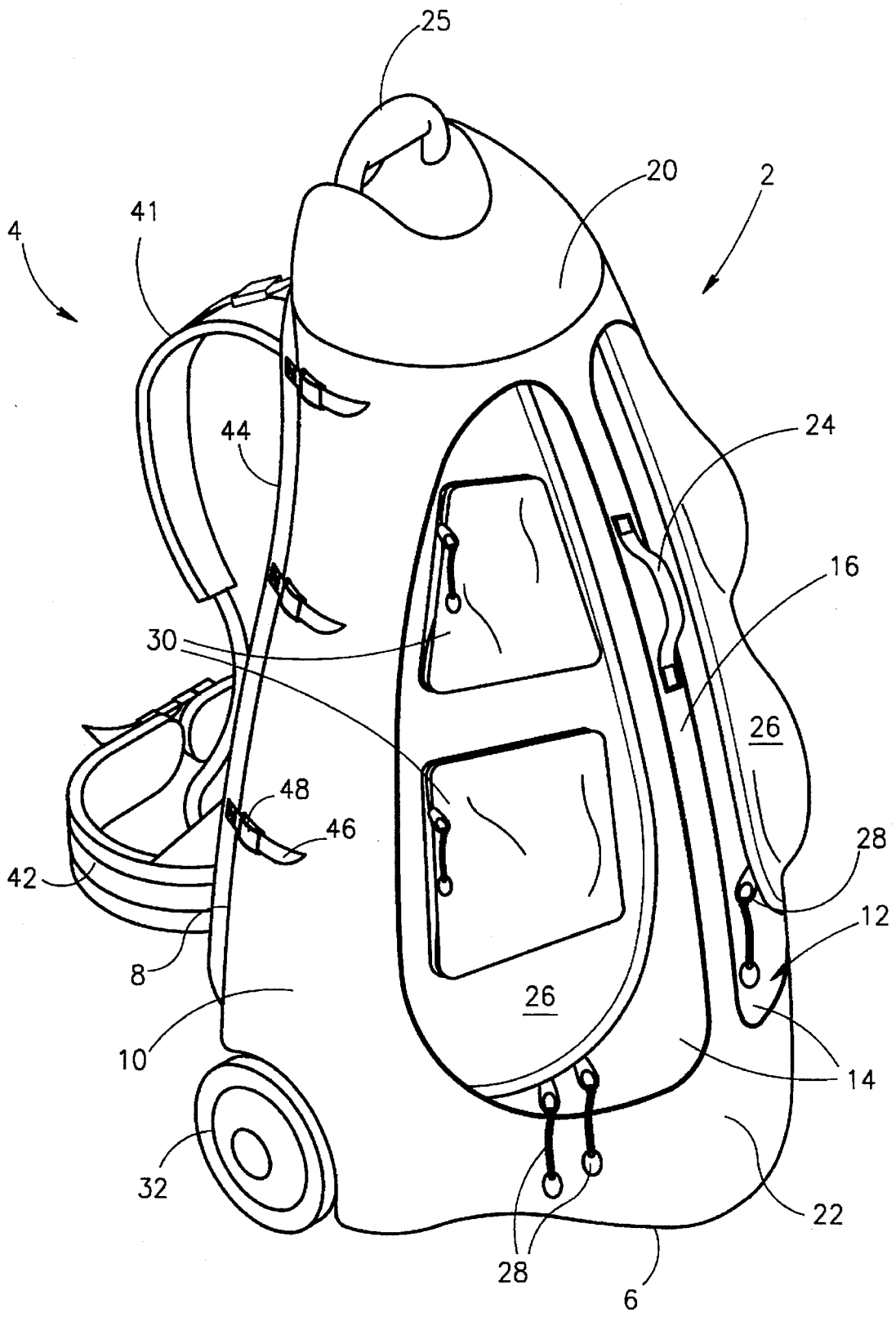
FIG. 1 is a perspective view of a knapsack according to the present invention with the carrying unit attached to the storage compartment.
Figure 2:
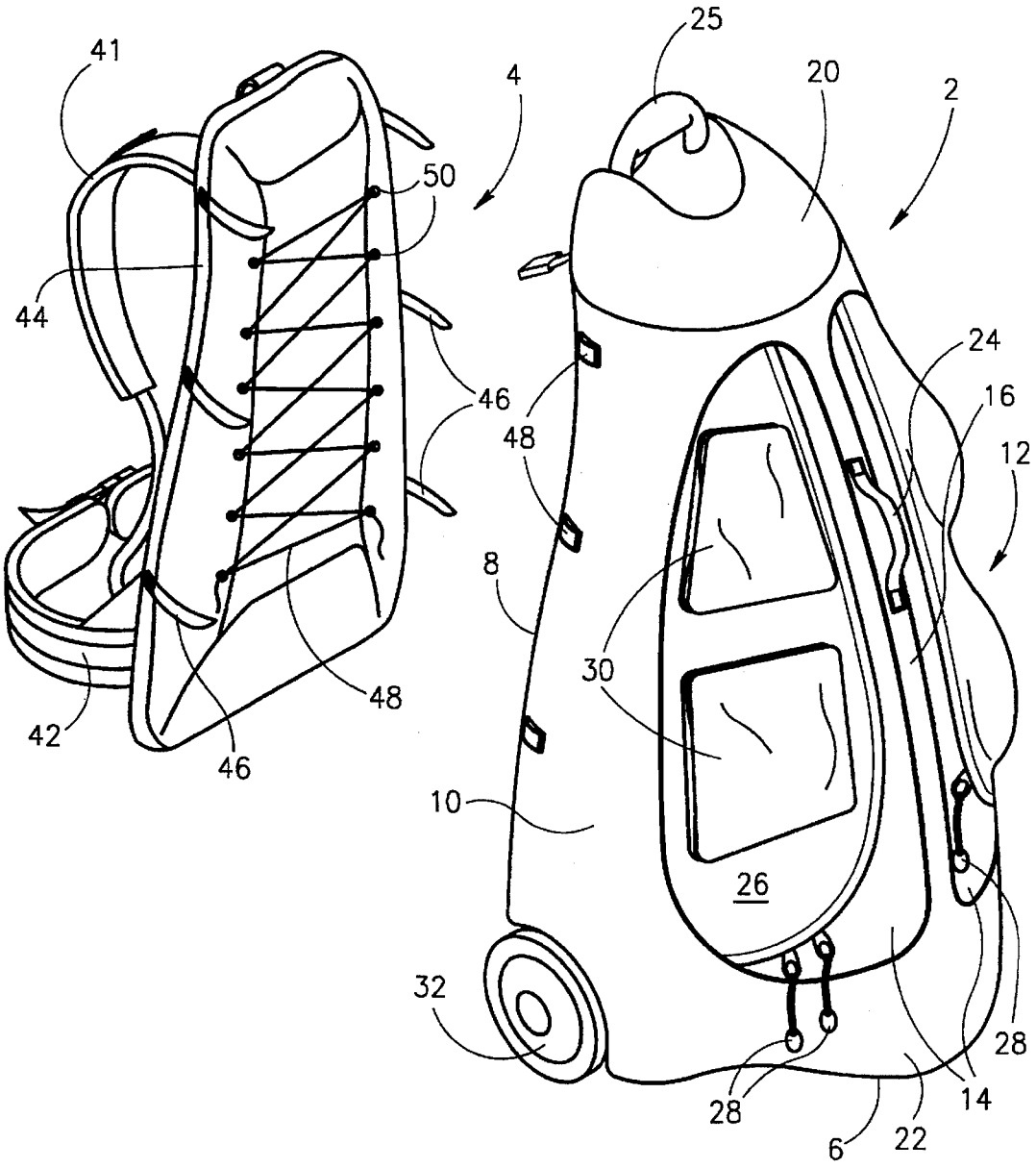
FIG. 2 is the knapsack of FIG. 1 shown with the carrying unit detached from the storage compartment.
Figure 2A:
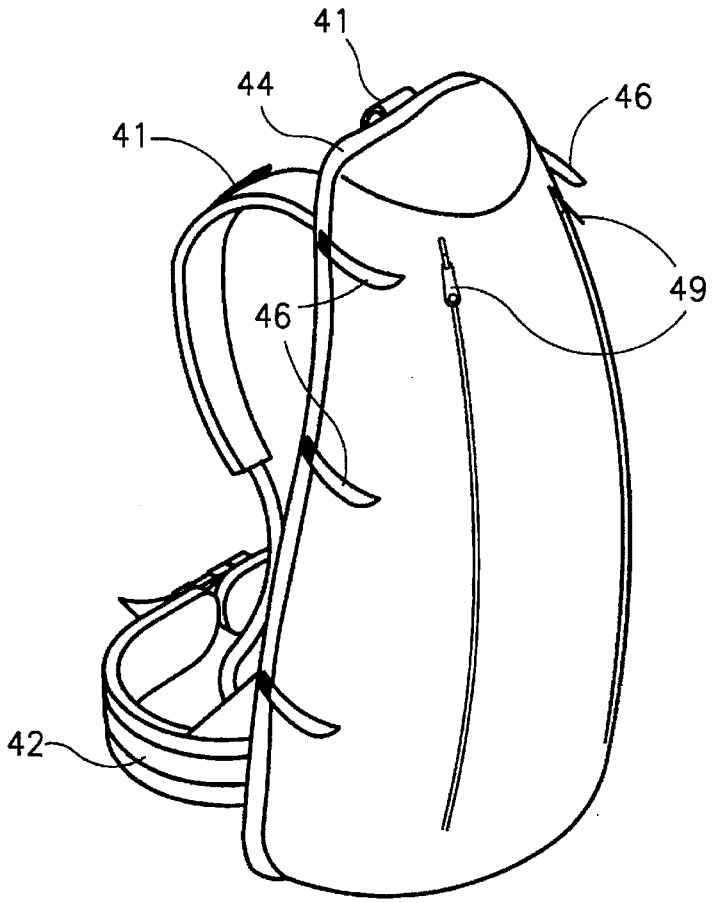

Referring first to FIGS. 1 and 2 of the drawings, there is seen a knapsack consisting of a storage compartment generally designated 2 and a carrying unit generally designated 4.

The storage compartment 2 comprises a bottom wall 6, a back wall 8 facing a person carrying the knapsack, side wall portions 10 adjacent the back wall 8 and a front wall 12 with openings 14. The bottom wall 6, the back wall 8 and portions of the side walls 10 adjacent the back wall 8 are made of a rigid material, e.g. a rigid polymer or complex material.

A strengthening rigid rib 16 bridges the rigid top portion 20 and the rigid bottom portion 22 with a carrying handle 24 attached to the rib 16. Another carrying handle 25 is located at the top portion 20 of the storage compartment.

The openings 14 are closable by covers 26 made of a flexible material, e.g. fabric closable by zippers 28. The covers 26 comprise several closable external pockets 30.

Two wheels 32 (only one of which is seen) are attached near the rear end of the bottom wall 6.

The carrying unit 4 is a collapsible rucksack 40 (seen in it's expanded form in FIG. 2(*a*)) comprising a pair of adjustable padded shoulder straps 41, an adjustable padded waist belt 42 and a padded back wall 44. The carrying unit 4 is attached to the storage compartment by a plurality of straps 46 and fasteners 48. The collapsible rucksack comprises closing means, e.g. a zipper 49 as known per se.

Before attaching the carrying unit 4 to the storage compartment 2, the rucksack is collapsed to the position shown in FIG. 2 and is maintained in this position by a lace 48 fastened between the plurality of loops 50. When the carrying unit 4 is removed from the storage compartment 2, the lace 48 is released and the carrying unit 4 may be expanded to the position shown in FIG. 2(*a*), serving as an independent rucksack, with the storage compartment resting in an upright position (as will hereinafter be explained) and serving as a storage unit.

Figure 3:
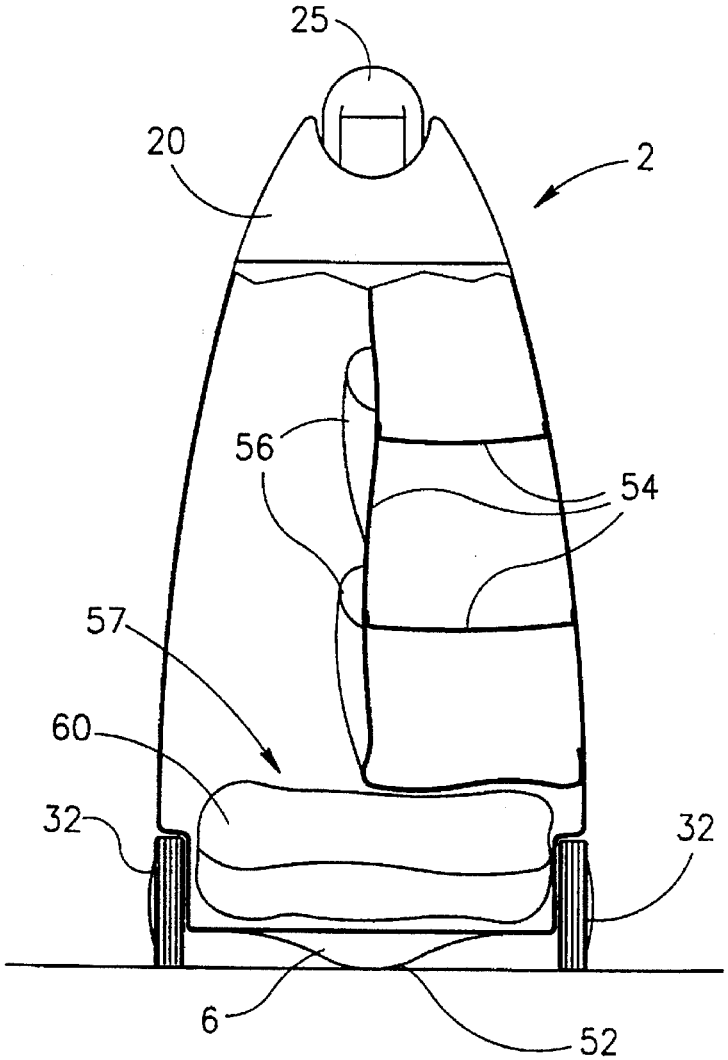
FIG. 3 is a partially cross-sectioned rear view of a knapsack according to the present invention.
Figure 4:
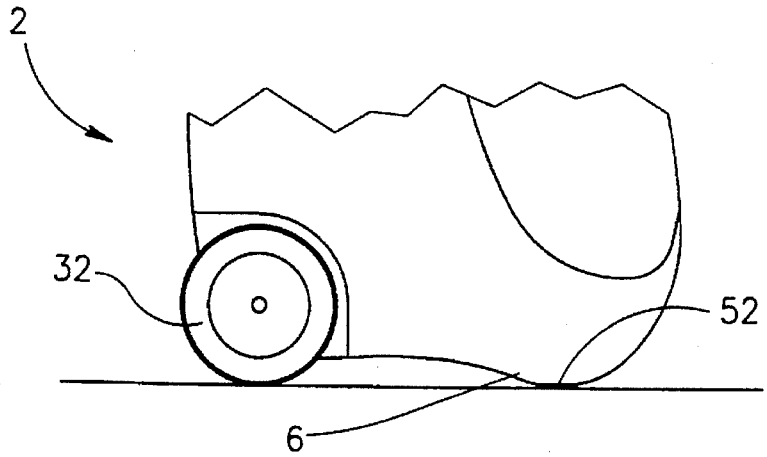
FIG. 4 is a partial side view of the knapsack according to the present invention.

Attention is now directed to FIGS. 3 and 4 of the drawings in which it can be seen that the bottom wall 6 of the storage compartment 2 comprises a portion 52 which together with the wheels 32 forms three resting points for supporting the knapsack in an essentially upright position (regardless of whether the carrying unit 4 is attached to the storage compartment 2 or not).

In FIG. 3, it can further be seen that the interior space of the storage compartment 2 is divided by modular partitions 54 which enable arrangement of the shelf-like partitions at different positions. The partitions may be releasably attached by pile and hook fasteners. The partitions may also comprise pockets 56 suitable for storing various items. The space 57 at the bottom of the storage compartment may be kept for essentially large articles 60, e.g. a sleeping bag, etc.

Figure 5:
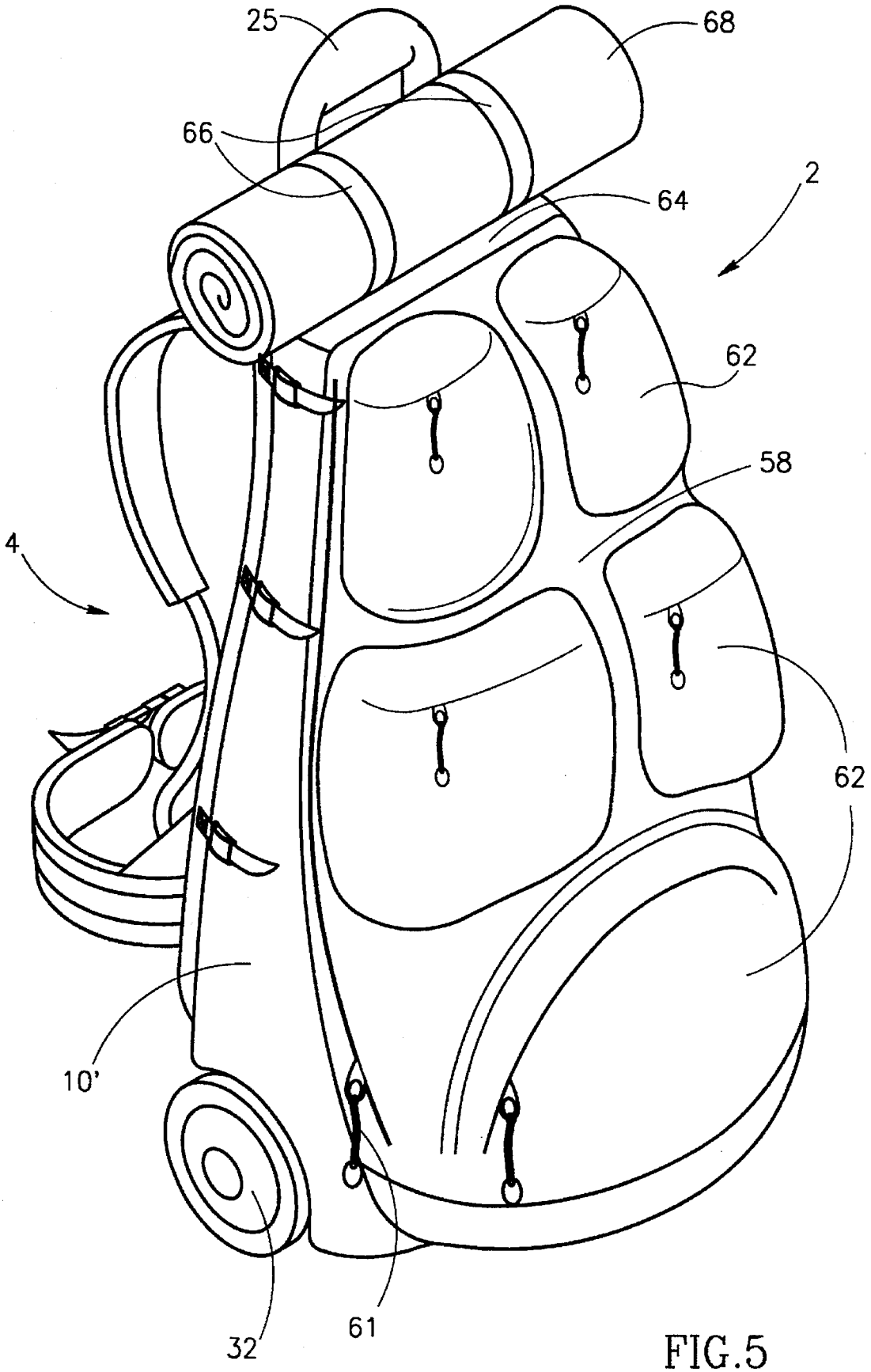
FIG. 5 is a perspective view of another embodiment of a knapsack according to the present invention.

FIG. 5 of the drawings illustrates another embodiment of the invention in which the front wall 58 is entirely made of a flexible material attached to the rigid side walls 10' closable by a zipper 61 and comprising a plurality of closable external pockets 62. A top portion 64 of the storage compartment 2 is essentially flat and comprises straps 66 for attaching camping equipment 68 such as a mattress, a sleeping bag or a tent.

Figure 6:
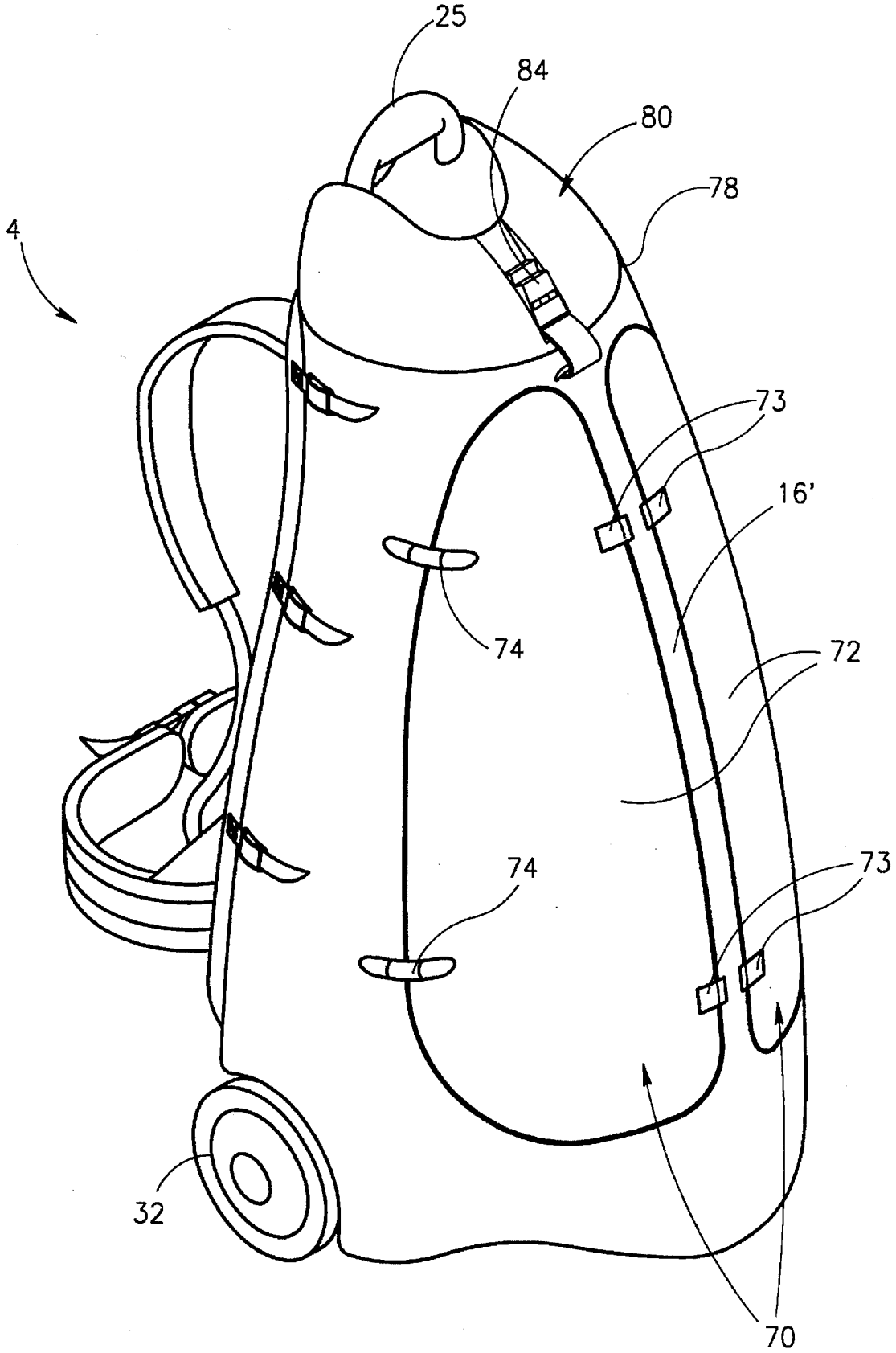
FIG. 6 is a perspective view of still another embodiment of a knapsack according to the present invention.

Attention is now directed to FIG. 6 in which the openings 70 of the storage compartment are closed by two doors 72 made of rigid material and hinged to the strengthening rib 16' by hinges 73 and lockable by snap-lock-type fasteners 74. According to the embodiment of FIG. 7, the entire storage compartment is made of rigid material.

Figure 7C:
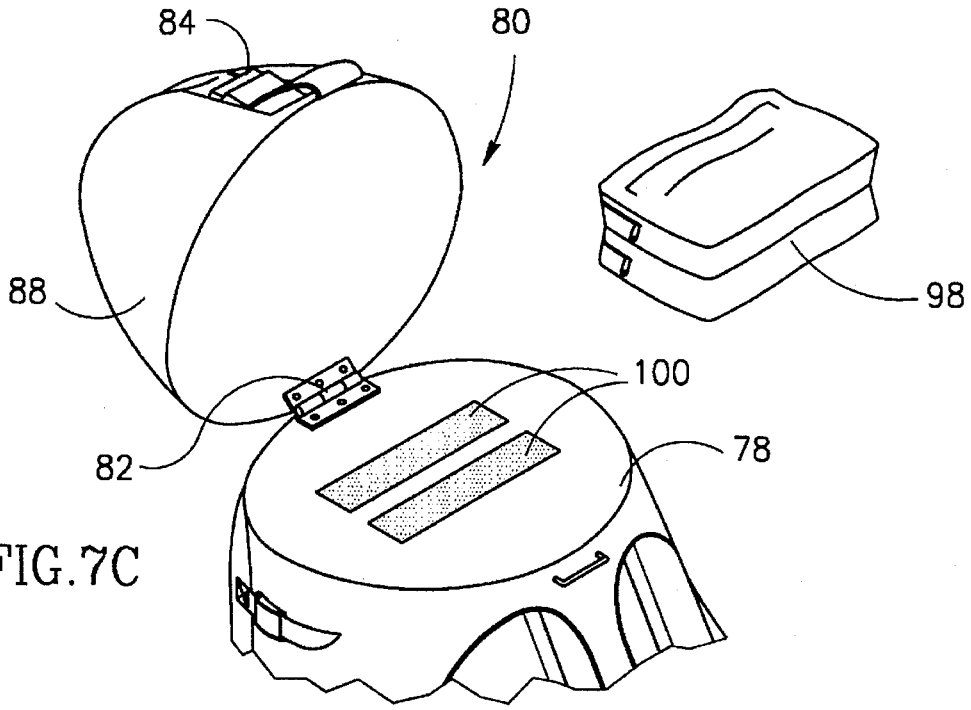
FIG. 7(*a*) is a perspective view of a top portion of a knapsack according to the present invention comprising an independent closable compartment.
Figure 7A:
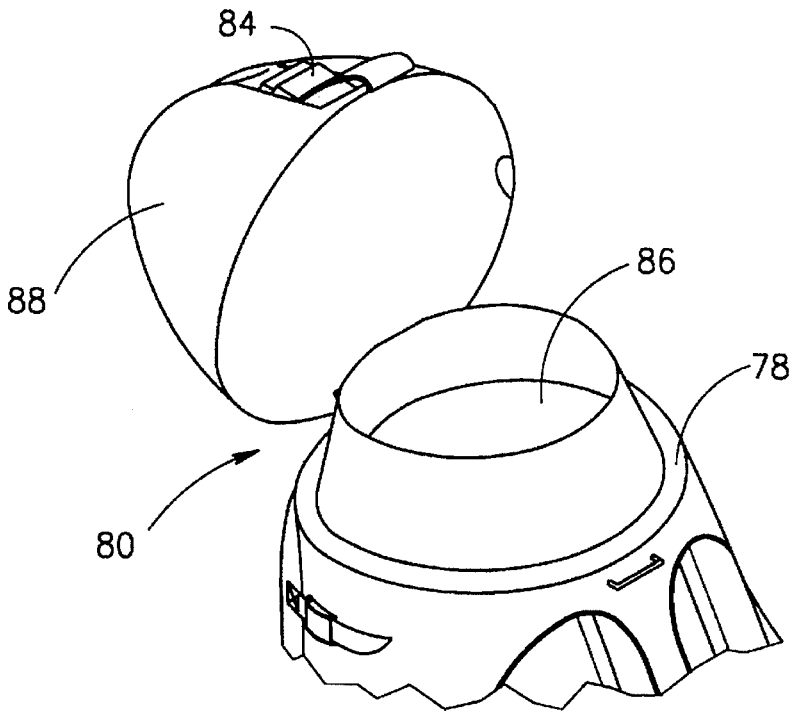
Figure 7B:
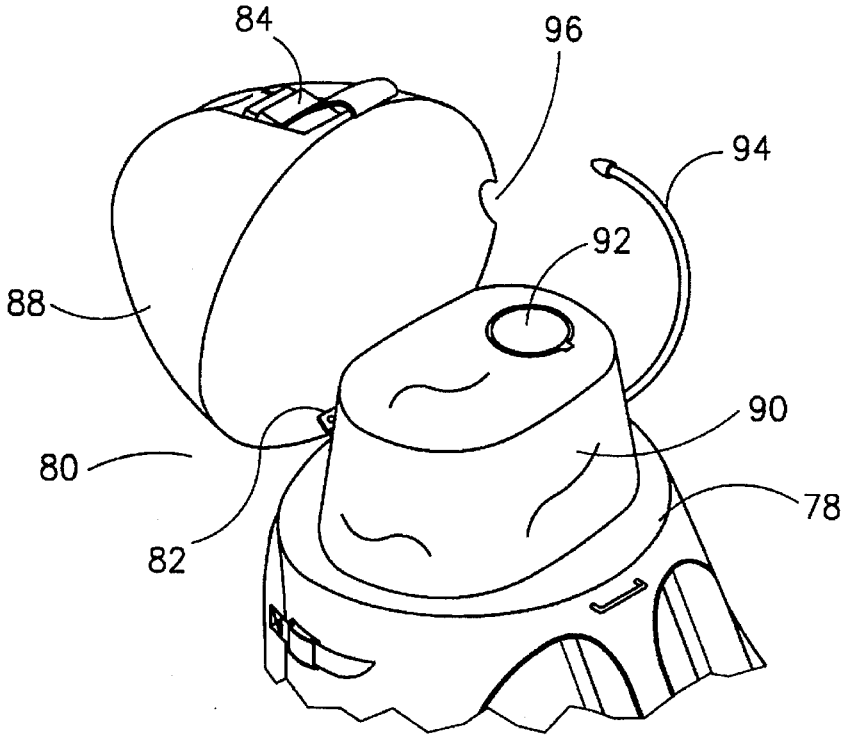

As further seen in FIGS. 7(*a*)–7(*c*), the top portion 78 of the storage compartment comprises an independent closable compartment 80 hinged at the back side by hinges 82 (seen in FIGS. 7(*b*) and 7(*c*)) and closable by closure 84 provided with a combination-type lock.

As seen in FIG. 7(*a*), the closable compartment 80 may be according to one embodiment of the invention, a chamber 86 with a closable cover 88, suitable for storing small personal items.

FIG. 7(*b*) is another embodiment of the invention in which the closable compartment 80 accommodates a liquid container 90 which may be removably attached to the top portion 78. The liquid container comprises a filling opening 92 and a drinking spout 94 extendable through a suitable opening 96 in the cover 88.

In FIG. 7(*c*) the closable compartment 80 accommodates a pouch 98 removably attached by a hook and pile fastener 100 to the top portion 78, the pouch suitable for carrying personal items, e.g. a wallet, glasses, etc.

Figure 8:
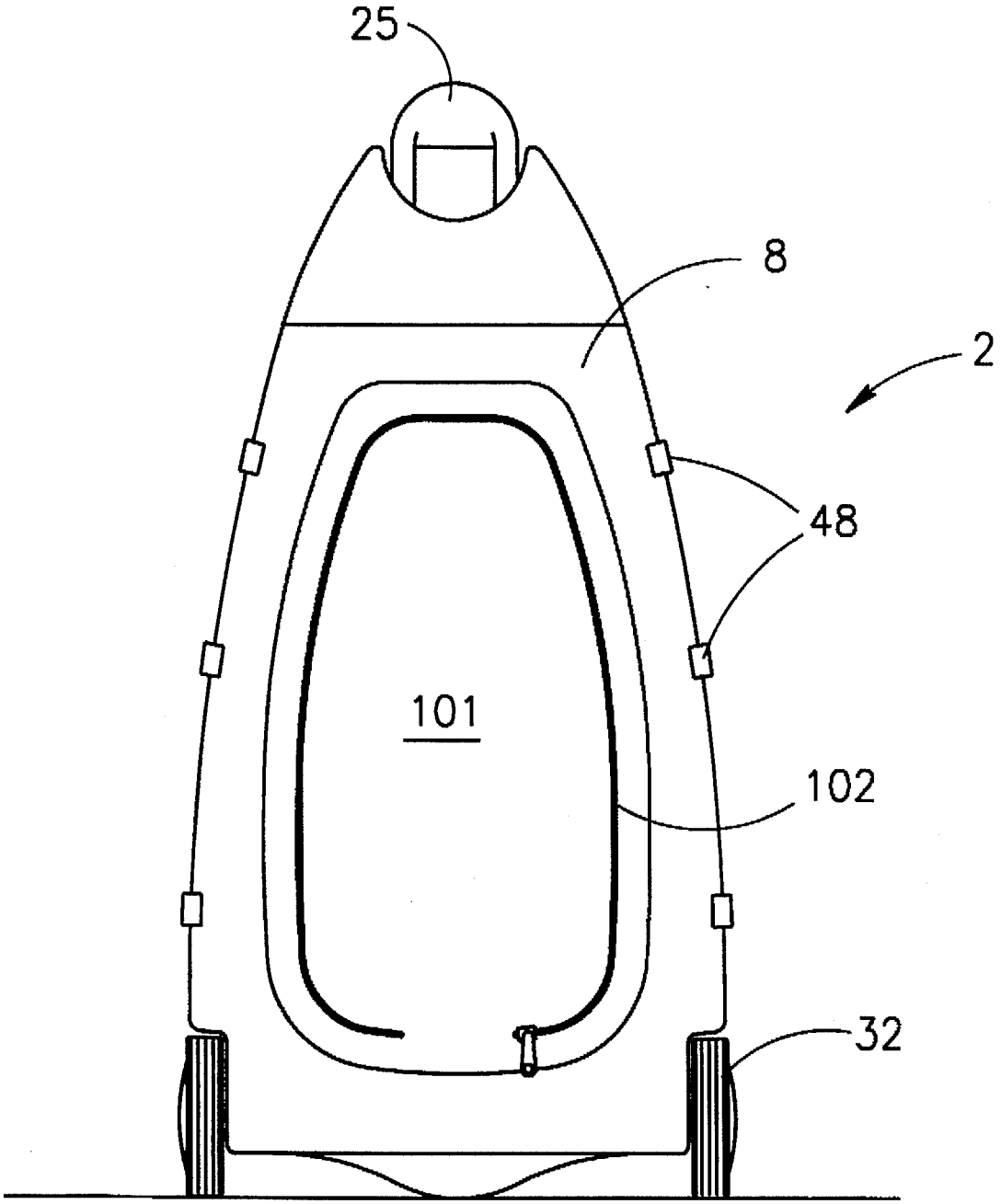
FIG. 8 is a rear view illustrating a modification of the knapsack according to the present invention, with the carrying unit removed.

In FIG. 8, the carrying unit 4 has been removed an the back wall 8 comprises an opening 101 which may be closed by a zipper 102 or a similar closure arrangement.

Figure 9B:
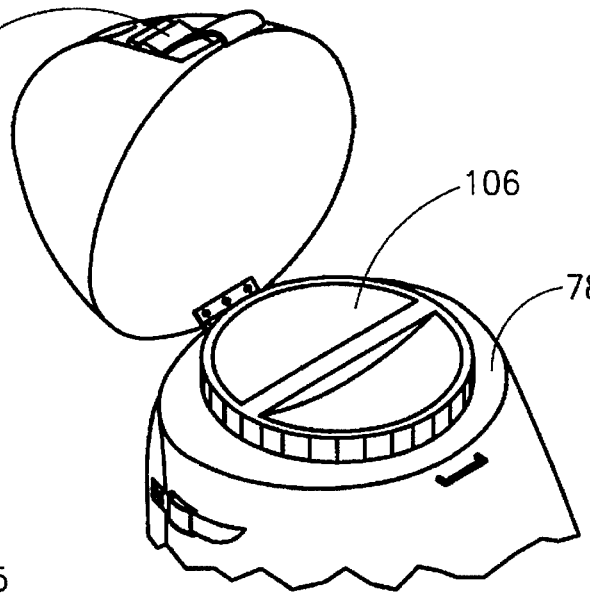
FIG. 9(*a*) is a perspective view of a further application of a knapsack in accordance with the present application.
Figure 9A:
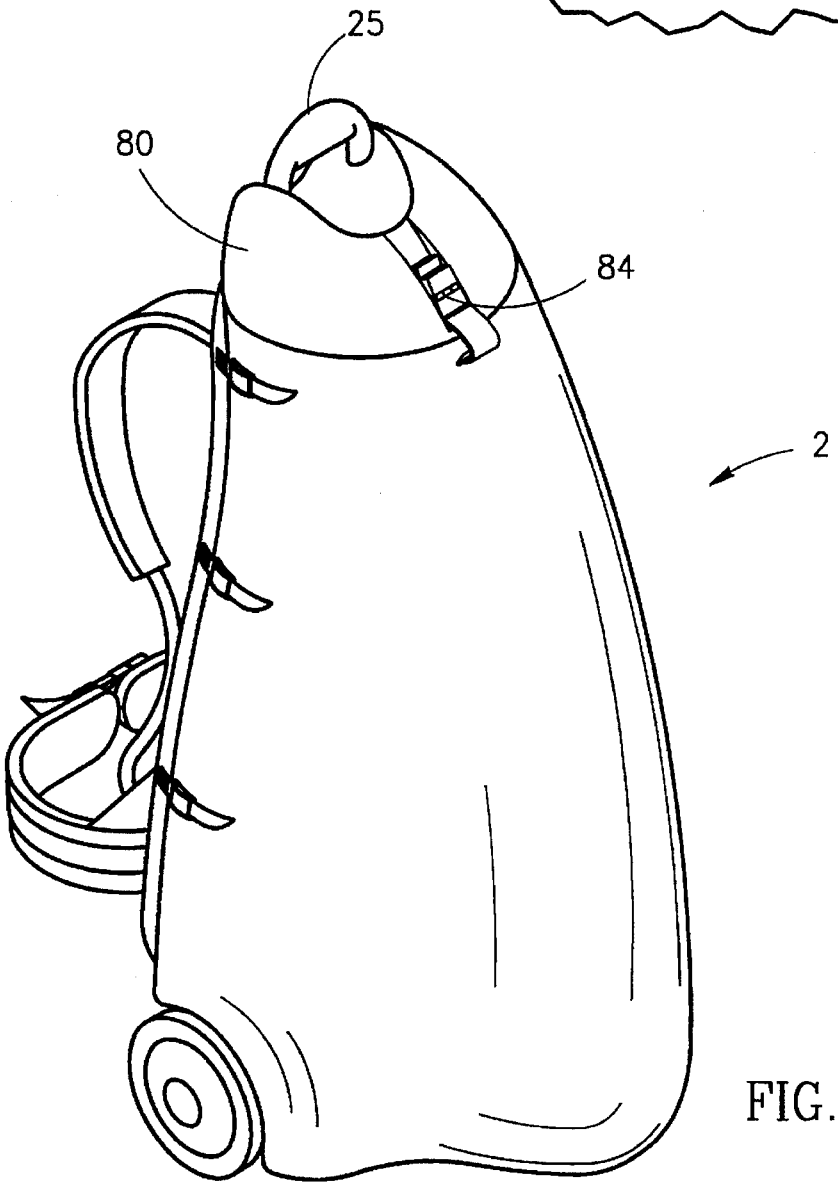

FIG. 9(*a*) and 9(*b*) of the drawings illustrate another application of the knapsack according to the present application according to which the entire storage compartment 2 is made of a rigid material with an opening provided at the top wall 78' thereof, under the closable cover. The opening of the storage compartment being closable by a water tight closure, whereby the storage compartment is waterproof. This arrangement is useful for example, for persons experiencing various water activities.

I claim:

1. A knapsack to be carried on a person's back comprising a storage compartment and a carrying unit; the storage compartment comprising a bottom wall, a back wall facing the person, a front wall and side wall portions adjacent the back wall; the walls of the storage compartment being substantially rigid and it comprises one or more openings; the carrying unit being releasably attached to said back wall, and comprises carrying straps and a collapsible rucksack which is collapsed when the carrying unit is attached to the storage compartment and may be expanded into a rucksack shape when the carrying unit is detached from the storage compartment.

2. A knapsack according to claim 1, wherein said collapsible rucksack forms a padding between the person's back and said back wall.

3. A knapsack according to claim 1, comprising wheels at said bottom wall.

4. A knapsack according to claim 1, wherein the bottom wall can stably support the knapsack in an upright position.

5. A knapsack according to claim 3, wherein the bottom wall has three resting points for stably supporting the knapsack when placed on the bottom wall, two of the resting points being said wheels.

6. A knapsack according to claim 3, wherein the wheels are at the intersection between the back wall and the bottom wall.

7. A knapsack according to claim 1, wherein said one or more openings of the storage compartment are made of a flexible material, with one or more openings being in said material.

8. A knapsack according to claim 1, wherein the openings are closable by rigid doors.

9. A knapsack according to claim 1, wherein the storage compartment comprises a rigid top portion comprising a closable compartment.

10. A knapsack according to claim 9, wherein the opening of said storage compartment is provided in said closable compartment.

11. A knapsack according to claim 10, wherein said storage compartment is essentially water-proof and wherein said opening is closable by a water-tight cover.

12. A knapsack according to claim 9, wherein said closable compartment is independent from said storage compartment.

13. A knapsack according to claim 12, wherein said independent compartment is or holds a liquid container.

14. A knapsack according to claim 12, wherein said independent compartment holds a detachable pouch.

15. A knapsack according to claim 1, wherein said storage compartment comprises modular partitions for dividing the storage compartment's interior.

16. A knapsack according to claim 1, wherein said storage compartment comprises a carrying handle.

* * * * *